United States Patent [19]

Ray

[11] 4,067,732

[45] Jan. 10, 1978

[54] AMORPHOUS ALLOYS WHICH INCLUDE IRON GROUP ELEMENTS AND BORON

[75] Inventor: Ranjan Ray, Morristown, N.J.

[73] Assignee: Allied Chemical Corporation, Morris Township, N.J.

[21] Appl. No.: 590,532

[22] Filed: June 26, 1975

[51] Int. Cl.[2] ..... C22C 38/32; C22C 19/05

[52] U.S. Cl. ..... 75/126 P; 75/122; 75/123 B; 75/123 K; 75/126 H; 75/128 B; 75/128 F; 75/134 F; 75/170; 75/171

[58] Field of Search ..... 75/122, 134 F, 170, 75/171, 126 P, 126 R, 126 G, 126 H, 128 F, 75/128 R, 128 E, 128 B, 123 K, 123 C

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 29/194 |
| 3,986,867 | 10/1976 | Masumoto et al. | 75/126 A |

*Primary Examiner*—Arthur J. Steiner
*Attorney, Agent, or Firm*—David W. Collins

[57] ABSTRACT

Iron group-boron base amorphous alloys have improved ultimate tensile strength and hardness and do not embrittle when heat treated at temperatures employed in subsequent processing steps, as compared with prior art amorphous alloys. The alloys have the formula $$M_aM'_bCr_cM''_dB_e$$

where M is one iron group element (iron, cobalt or nickel) M′ is at least one of the two remaining iron group elements, M″ is at least one element of vanadium, manganese, molybdenum, tungsten, niobium and tantalum, "*a*" ranges from about 40 to 85 atom percent, "*b*" ranges from 0 to about 45 atom percent, "*c*" and "*d*" both range from 0 to about 20 atom percent and "*e*" ranges from about 15 to 25 atom percent, with the proviso that "*b*", "*c*" and "*d*" cannot all be zero simultaneously.

13 Claims, No Drawings

AMORPHOUS ALLOYS WHICH INCLUDE IRON GROUP ELEMENTS AND BORON

BACKGROUND OF THE INVENTION

1. Field of the Invention

The invention is concerned with amorphous metal alloys and, more particularly, with amorphous metal alloys which include the iron group elements (iron, cobalt and nickel) plus boron.

2. Description of the Prior Art

Novel amorphous metal alloys have been disclosed and claimed by H. S. Chen and D. E. Polk in U.S. Pat. No. 3,856,513, issued Dec. 24, 1974. These amorphous alloys have the formula $M_aY_bZ_c$, where M is at least one metal selected from the group consisting of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "*a*" ranges from about 60 to 90 atom percent, "*b*" ranges from about 10 to 30 atom percent and "*c*" ranges from about 0.1 to 15 atom percent. These amorphous alloys have been found suitable for a wide variety of applications, including ribbon, sheet, wire, powder, etc. Amorphous alloys are also disclosed and claimed having the formula $T_iX_j$, where T is at least one transition metal, X is at least one element selected from the group consisting of aluminum, antimony, beryllium, boron, germanium, carbon, indium, phosphorus, silicon and tin, "*i*" ranges from about 70 to 87 atom percent and "*j*" ranges from about 13 to 30 atom percent. These amorphous alloys have been found suitable for wire applications.

At the time these amorphous alloys were discovered, they evidenced mechanical properties that were superior to then-known polycrystalline alloys. Such superior mechanical properties included ultimate tensile strengths up to 350,000 psi, hardness values of about 600 to 750 DPH and good ductility. Nevertheless, new applications requiring improved magnetic, physical and mechanical properties and higher thermal stability have necessitated efforts to develop further specific compositions.

SUMMARY OF THE INVENTION

In accordance with the invention, iron group-boron base amorphous alloys have improved ultimate tensile strength and hardness and do not embrittle when heat treated at temperatures employed in subsequent processing steps. These amorphous metal alloys also have desirable magnetic properties. These amorphous alloys consist essentially of the composition $$M_aM'_bCr_cM''_dB_e$$

where M is one element selected from the group consisting of iron, cobalt and nickel, M' is one or two elements selected from the group consisting of iron, cobalt and nickel other than M, M'' is at least one element of vanadium, manganese, molybdenum, tungsten, niobium and tantalum, "*a*" ranges from about 40 to 85 atom percent, "*b*" ranges from 0 to about 45 atom percent "*c*" and "*d*" each ranges from 0 to about 20 atom percent and "*e*" ranges from about 15 to 25 atom percent, with the proviso that "*b*", "*c*" and "*d*" cannot all be zero simultaneously.

Preferably, chromium is present in an amount of about 4 to 16 atom percent of the total alloy composition to attain enhanced mechanical properties, improved thermal stability, and corrosion and oxidation resistance. Preferred compositions also include compositions where M'' is molybdenum, present in an amount of about 0.4 to 8 atom percent of the total alloy composition to attain increased hardness. For preferred compositions having desirable magnetic properties, "*c*" and "*d*" are both zero.

The alloys of this invention are at least 50% amorphous, and preferably at least 80% amorphous and most preferably about 100% amorphous, as determined by X-ray diffraction.

The amorphous alloys in accordance with the invention are fabricated by a processs which comprises forming melt of the desired composition and quenching at a rate of about $10^{5°}$ to $10^{6°}$ C/sec by casting molten alloy onto a chill wheel or into a quench fluid. Improved physical and mechanical properties, together with a greater degree of amorphousness, are achieved by casting the molten alloy onto a chill wheel in a partial vacuum having an absolute pressure of less than about 5.5 cm of Hg.

DETAILED DESCRIPTION OF THE INVENTION

There are many applications which require that an alloy have, inter alia, a high ultimate tensile strength, high thermal stability and ease of fabricability. For example, metal ribbons used in razor blade applications usually undergo a heat treatment of about 370° C for about 30 min to bond an applied coating of polytetrafluoroethylene to the metal. Likewise, metal strands used as tire cord undergo a heat treatment of about 160° to 170° C for about 1 hr to bond tire rubber to the metal.

When crystalline alloys are employed, phase changes can occur during heat treatment that tend to degrade the physical and mechanical properties. Likewise, when amorphous alloys are employed, a complete or partial transformation from the glassy state to an equilibrium or a metastable crystalline state can occur during heat treatment. As with inorganic oxide glasses, such a transformation degrades physical and mechanical properties such as ductility, tensile strength, etc.

The thermal stability of an amorphous metal alloy is an important property in certain applications. Thermal stability is characterized by the time-temperature transformation behavior of an alloy, and may be determined in part by DTA (differential thermal analysis). As considered here, relative thermal stability is also indicated by the retention of ductility in bending after thermal treatment. Alloys with similar crystallization behavior as observed by DTA may exhibit different embrittlement behavior upon exposure to the same heat treatment cycle. By DTA measurement, crystallization temperatures, $T_c$, can be accurately determined by slowly heating an amorphous alloy (at about 20° to 50° C/min) and noting wheter excess heat is evolved over a limited temperature range (crystallization temperature) or whether excess heat is absorbed over a particular temperature range (glass transition temperature). In general, the glass transition temperature $T_g$ is near the lowest, or first, crystallization temperature, $T_{cl}$, and, as is convention, is the temperature at which the viscosity ranges from about $10^{13}$ to $10^{14}$ poise.

Most amorphous metal alloy compositions containing iron, nickel, cobalt and chromium which include phosphorus, among other metalloids, evidence ultimate tensile strengths of about 265,000 to 350,000 psi and crystallization temperatures of about 400° to 460° C. For example, an amorphous alloy have the composition $Fe_{76}P_{16}C_4Si_2Al_2$ (the subscripts are in atom percent) has an ultimate tensile strength of about 310,000 psi and a crystallization temperature of about 460° C, an amorphous alloy having the composition $Fe_{30}Ni_{30}Co_{20}P_{13}B_5Si_2$ has an ultimate tensile strength of about 265,000 psi and a crystallization temperature of about 415° C, and an amorphous alloy having the composition $Fe_{74.3}Cr_{4.5}P_{15.9}C_5B_{0.3}$ has an ultimate tensile strength of about 350,000 psi and a crystallization temperature of 446° C. The thermal stability of these compositions in the temperature range of about 200° to 350° C is low, as shown by a tendency to embrittle after heat treating, for example, at 250° C for 1 hr or 300° C for 30 min or 330° C for 5 min. Such heat treatments are required in certain specific applications, such as curing a coating of polytetrafluoroethylene on razor blade edges or bonding tire rubber to metal wire strands.

In accordance with the invention, iron group-boron base amorphous alloys have improved ultimate tensile strength and a hardness and do not embrittle when heat treated at temperatures typically employed in subsequent processing steps. These amorphous metal alloys consist essentially of the composition $$M_aM'_bCr_cM''_dB_e$$

where M is one iron group element (iron, cobalt or nickel), M′ is at least one of the remaining two iron group elements, M″ is at least one element of vanadium, manganese, molybdenum, tungsten, niobium and tantalum, "*a*" ranges from about 40 to 85 atom percent, "*b*" ranges from 0 to about 45 atom percent "*c*" and "*d*" each ranges from 0 to about 20 atom percent and "*e*" ranges from about 15 to 25 atom percent, with the proviso that "*b*", "*c*" and "*d*" cannot all be zero simultaneously. Examples of amorphous alloy compositions in accordance with the invention include $Fe_{50}Ni_5Co_7Cr_{10}Mo_{10}B_{18}$, $Fe_{40}Ni_{20}Co_{10}Cr_{10}B_{20}$, $Ni_{46}Fe_{13}Co_{13}Cr_9Mo_3B_{16}$, $Co_{50}Fe_{18}Ni_{15}B_{17}$, $Fe_{65}V_{15}B_{20}$ and $Ni_{58}Mn_{20}B_{22}$. The purity of all compositions is that found in normal commercial practice.

The amorphous metal alloys in accordance with the invention typically evidence ultimate tensile strengths ranging from about 370,000 to 520,000 psi, hardness values ranging from about 925 to 1190 DPH and crystallization temperatures ranging from about 370° to 610° C.

Optimum resistance to corrosion and oxidation is obtained by including about 4 to 16 atom percent of chromium in the alloy composition. Addition of such amounts of chromium in general also enhances the crystallization temperature, the tensile strength, and the thermal stability of the amorphous metal alloys. Below about 4 atom percent, insufficient corrosion inhibiting behavior is observed, while greater than about 16 atom percent of chromium tends to decrease the resistance to embrittlement upon heat treatment at elevated temperatures of the amorphous metal alloys.

An increase in hardness and crystallization temperature is achieved where M″ is molybdenum. Preferably, about 0.4 to 8 atom percent of molybdenum is included in the alloy composition. Below about 0.4 atom percent, a substantial increase in hardness is not obtained. Above about 8 percent, while increased hardness values are obtained, the thermal stability is reduced, necessitating a balancing of desired properties. For many compositions, improved mechanical properties and increased crystallization temperatures are achieved, at some sacrifice in thermal stability, by including about 4 to 8 atom percent of molybdenum in the entire alloy composition. For example, an amorphous metal alloy having the composition $Fe_{67}Ni_5Co_3Cr_7B_{18}$ has a crystallization temperature of 488° C, a hardness of 1003 DPH and an ultimate tensile strength of 417,000 psi, while an amorphous metal alloy having the composition $Fe_{63}Ni_5Co_3Cr_7Mo_4B_{18}$ has a crystallization temperature of 528° C, a hardness of 1048 DPH and an ultimate tensile strength of 499,000 psi. For some compositions, improved thermal stability and improved hardness is unexpectedly achieved by including about 0.4 to 0.8 atom percent of molybdenum in the allow composition. For comparison, an amorphous metal alloy having the composition $Fe_{66}Ni_5Co_4Cr_8B_{17}$ has a hardness of 1038 DPH and remains ductile after heat treatment at 360° C for 30 min, but embrittles after heat treatment at 370° for 30 min; an amphorous metal alloy having the composition $Fe_{66}Ni_5Co_{3.2}Cr_8Mo_{0.8}B_{17}$ has a hardness of 1108 DPH and remains ductile after heat treatment at 370° C for 30 min.

Many preferred compositions ranges within he inventive compositions range may be set forth, depending upon specific desired improved properties.

For iron base amorphous metal alloys, high strength and high hardness are obtained for alloys having compositions in the range $$Fe_{50\text{-}70}(Ni,Co)_{5\text{-}15}Cr_{5\text{-}16}Mo_{0\text{-}8}B_{16\text{-}22}.$$

Examples include $Fe_{54}Ni_6Co_5Cr_{16}Mo_2B_{17}$, $Fe_{60}Ni_7Co_7Cr_8B_{18}$ and $Fe_{63}Ni_5Co_3Cr_7Mo_4B_{18}$. The ultimate tensile strength of such compositions typically range from about 415,000 to 500,000 psi, the hardness values range from about 1025 to 1120 DPH, and the crystallization temperatures range from about 480° to 550° C. Alloys within this composition range have been found particularly suitable for fabricating tire cord filaments.

High thermal stability is obtained for alloys having compositions in the range $$Fe_{60\text{-}67}Ni_{3\text{-}7}Co_{3\text{-}7}Cr_{7\text{-}10}Mo_{0.4\text{-}0.8}B_{17}.$$

Examples include $Fe_{66}Ni_5Co_{3.6}Cr_8Mo_{0.4}B_{17}$ and $Fe_{66}Ni_5Co_{3.2}Cr_8Mo_{0.8}B_{17}$. Such compositions generally remain ductile to bending following heat treatments at 360° to 370° C for ½ hr. Alloys within this composition range have been found particularly suitable for fabricating razor blade strips.

For nickel base amorphous metal alloys, high hardness, moderately high strength, high thermal stability and corrosion resistance are obtained for alloys having composition in the range $$Ni_{40\text{-}50}Fe_{4\text{-}15}Co_{5\text{-}25}Cr_{8\text{-}12}Mo_{0\text{-}9}B_{15\text{-}22}.$$

Examples in include $Ni_{40}Fe_5Co_{20}Cr_{10}Mo_9Br_{16}$, $Ni_{45}Fe_5Co_{20}Cr_{10}Mo_9B_{16}$ $Ni_{45}Fe_5Co_{20}Cr_{10}Mo_4B_{16}$ and $Ni_{50}Fe_5Co_{17}Cr_9Mo_3B_{16}$. The ultimate strengths of such compositions are typically about 395,000 to 415,000 psi; the hardness values typically range from about 980 to 1045 DPH.

For cobalt base amorphous metal alloys, high strength, high thermal stability and high hardness are obtained for alloys having compositions in the range $Co_{40-50}Fe_{5-20}Ni_{0-20}Cr_{4-15}Mo_{0-9}B_{15-23}$.

Examples include $Co_{45}Fe_{17}Ni_{13}Cr_5Mo_3B_{17}$, $Co_{50}Fe_{15}Cr_{15}Mo_4B_{16}$, $Co_{46}Fe_{18}Ni_{15}Mo_4B_{17}$ and $Co_{50}Fe_{10}Ni_{10}Cr_{10}B_{20}$. The hardness values of such compositions are typically about 1100 DPH.

Preferred amorphous metal alloys having desirable magnetic properties depend on the specific application desired. For such compositions, both "*c*" and "*d*" are zero. For high saturation magnetization values, e.g., about 13 to 17 kGauss, it is desired that a relatively high amount of cobalt and/or iron be present. Examples include $Fe_{81}Co_3Ni_1B_{15}$ and $Fe_{80}Co_5B_{15}$. For low coercive force less than about 0.5 Oe, it is desired that a relatively high amount of nickel and/or iron be present. Examples include $Ni_{50}Fe_{32}B_{18}$ and $Fe_{50}Ni_{20}Co_{15}B_{15}$. Suitable magnetic amorphous metal alloys have compositions in the range $Fe_{40-80}Co_{5-45}B_{15-}$ $Co_{40-80}Fe_{5-45}B_{15-25}$ $Fe_{40-80}Ni_{5-45}B_{15-25}$ $Ni_{40-80}Fe_{5-45}B_{15-25}$ $Co_{40-80}Ni_{5-45}B_{15-25}$ $Ni_{40-65}Co_{20-45}B_{15-25}$ $Fe_{40-70}Ni_{4-25}Co_{5-30}B_{15-25}$ $Ni_{40-70}Fe_{5-25}Co_{5-25}B_{15-25}$ $Co_{40-70}Fe_{5-25}Ni_{5-25}B_{15-25}$.

Examples include $Fe_{60}Co_{20}B_{20}$, $Co_{70}Fe_{10}B_{20}$, $Co_{40}Fe_{40}B_{20}$, $Ni_{70}Fe_{12}B_{18}$, $Fe_{52}Ni_{30}B_{18}$, $Fe_{62}Ni_{20}B_{18}$, $Co_{72}Ni_{10}B_{18}$, $Co_{62}Ni_{20}B_{18}$, $Fe_{70}Ni_{7.5}Co_{7.5}B_{15}$, $Fe_{50}Ni_5Co_{28}B_{17}$, $Fe_{50}Ni_{20}Co_{15}B_{15}$, $Fe_{60}Ni_7Co_{12}B_{21}$, $Fe_{70}Ni_4Co_5B_{21}$, $Ni_{50}Fe_{18}Co_{15}B_{17}$, $co_{50}Fe_{18}Ni_{15}B_{17}$ and $Co_{60}Fe_{13}Ni_{10}B_{17}$.

The amorphous alloys are formed by cooling a melt at a rate of about $10^{50}$ to $10^{6}$°C/sec. A variety of techniques are available, as is now well-known in the art, for fabrication splat-quenched foils and rapid-quenched continuous ribbons, wire, sheet, etc. Typically, a particular composition is selected, powders of the requisite elements (or of materials that decompose to form the elements, such as ferroboron, ferrochrome, etc.) in the desired proportions are melted and homogenized, and the molten alloy is rapidly quenched either on a chill surface, such as a rotating cooled cylinder, or in a suitable fluid medium, such as a chilled brine solution. The amorphous alloys may be formed in air. However, superior mechanical properties are achieved by forming these amorphous alloys in a partial vacuum with absolute pressure less than about 5.5 cm of Hg, and preferably about 100$\mu$ m to 1 cm of Hg, as disclosed in a patent application of R. Ray et al., Ser. No. 552,673, filed Feb. 24, 1975.

The amorphous metal alloys are at least 50% amorphous, and preferably at least 80% amorphous, as measured by X-ray diffraction. However, a substantial degree of amorphousness approaching 100% amorphous is obtained by forming these amorphous metal alloys in a partial vacuum. Ductility is thereby improved, and such alloys possessing a substantial degree of amorphousness are accordingly preferred.

The amorphous metal alloys of the present invention evidence superior fabricability, compared with prior art compositions. In addition to their improved resistance to embrittlement after heat treatment, these compositions tend to be more oxidation and corrosion resistant than prior art compositions.

These compositions remain amorphous at heat treating conditions under which phosphorus-containing amorphous alloys tend to embrittle. Ribbons of these alloys find use in applications requiring relatively high thermal stability and increased mechanical strength.

EXAMPLES

Rapid melting and fabrication of amorphous strips of ribbons of uniform width and thickness from high melting (about 1100° to 1600° C) reactive alloys was accomplished under vacuum. The application of vacuum minimized oxidation and contamination of the alloy during melting or squirting and also eliminated surface damage (blisters, bubbles, etc.) commonly observed in strips processed in air or inert gas at 1 atm. A copper cylinder was mounted vertically on the shaft of a vacuum rotary feedthrough and placed in a stainless steel vacuum chamber. The vacuum chamber was a cylinder flanged at two ends wth two side ports and was connected to a diffusion pumping system. The copper cylinder was rotated by variable speed electric motor via the feedthrough. A crucible surrounded by an induction coil assembly was located above the rotating cylinder inside the chamber. An induction power supply was used to melt alloys contained in crucibles made of fused quartz, boron nitride, alumina, zirconia or beryllia. The amorphous ribbons were prepared by melting the alloy in a suitable non-reacting crucible and ejecting the melt by over-pressure of argon through an orifice in the bottom of the crucible onto the surface of the rotating (about 1500 to 2000 rpm) cylinder. The melting and squirting were carried out in a partial vacuum of about 100 $\mu$ m, usng an inert gas such as argon to adjust the vacuum pressure.

Using the vacuum-melt casting apparatus described above, a number of various glass-forming iron group-boron base alloys were chill cast as continuous ribbons having substantially uniform thickness and width. Typically, the thickness ranged from 0.001 to 0.003 inch and the width ranged from 0.05 to 0.12 inch. The ribbons were checked for amorphousness by X-ray diffraction and DTA. Hardness (in DPH) was measured by the diamond pyramid technique, using a Vickers-type indenter consisting of a diamond in the form of a square-based pyramid with an included angle of 136° between opposite faces. Tensile tests to determine ultimate tensile strength (in psi) were carried out using an Instron machine. The mechanical behavior of amorphous metal alloys having compositions in accordance with the invention was measured as a function of heat treatment. All alloys were fabricated by the process given above. The amorphous ribbons of the alloys were all ductile in the as-quenched condition. The ribbons were bent end on end to form a loop. The diameter of the loop was gradually reduced between the anvils of a micrometer. The ribbons were considered ductile if they could be bent to a radius of curvature less than about 0.005 inch without fracture. If a ribbon fractured, it was considered to be brittle.

EXAMPLE 1

Alloys Suitable for Tire Cord Applications

Alloys that would be suitable for tire cord applications, such as for metal belts in radial-ply tires, must be able to withstand about 160° to 170° C for about 1 hr, which is the temperature usually employed in curing a rubber tire. The alloys must also be resistant to corrosion by sulfur and evidence high mechanical strength. Examples of compositions of alloys suitable for tire cord applications and their crystallization temperature in ° C are listed in Table I below. These alloys are described by the composition $Fe_{50-70}(Ni,Co)_{5-15}Cr_{5-16}Mo_{0-8}B_{16-22}$.

The alloys were prepared under the conditions described above. All alloys remained ductile and fully amorphous following heat treatment at 200° C for 1 hr. After the foregoing heat treatment, these alloys retained the hardness and mechanical strength values observed for the as-quenched alloys.

TABLE I

Thermal and Mechanical Properties of Some Iron-Group-Boron Base Amorphous Compositions Suitable for Tire Cord Applications

| Alloy Composition (Atom Percent) | Hardness (DPH) | Crystallization Temperature (° C) | Ultimate Tensile Strength (psi) |
|---|---|---|---|
| $Fe_{67}Ni_5Co_3Cr_7B_{18}$ | 1083 | 488 | 417,000 |
| $Fe_{63}Ni_5Co_3Cr_7Mo_4B_{18}$ | 1048 | 528 | 499,000 |
| $Fe_{60}Ni_7Co_7Cr_8B_{18}$ | 1025 | 481 | 488,000 |
| $Fe_{59}Ni_5Co_3Cr_7Mo_8B_{18}$ | 1120 | 553,624 | 413,000 |
| $Fe_{55}Ni_{10}Co_5Cr_{10}B_{20}$ | 1048 | 487 | 477,000 |
| $Fe_{55}Ni_8Co_5Cr_{15}B_{17}$ | 1085 | 496 | 455,000 |
| $Fe_{54}Ni_6Co_5Cr_{16}Mo_2B_{17}$ | 1097 | 519 | 478,000 |
| $Fe_{53}Ni_6Co_5Cr_{16}Mo_3B_{17}$ | 1033 | 508 | 444,000 |

EXAMPLE 2

Alloys Suitable for Razor Blade Applications

Alloys that would be suitable for razor blade applications must be able to withstand about 370° C for about 30 min, which is the processing condition required to apply a coating of polytetrafluoroethylene to the cutting edge. Such alloys should be able to remain ductile and fully amorphous and retain high hardness and corrosion resistance behavior after the foregoing heat treatment. Table II below lists some typical compositions of the suitable for use as razor blades. These alloys are described by the composition $Fe_{60-67}Ni_{3-7}Co_{3-7}Cr_{7-10}Mo_{0.4-0.8}B_{17}$.

All alloys remain ductile and fully amorphous after heat treatment of 370° C for 30 min. After the foregoing heat treatment, these alloys retained the hardness and corrosion resistant behavior observed for the as-quenched alloys.

TABLE II

Thermal and Mechanical Properties of Some Iron Group-Boron Base Amorphous Compositions Suitable for Razor Blade Applications

| Composition (atom percent) | Hardness (DPH) | Crystallization Temperature, ° C |
|---|---|---|
| $Fe_{66}Ni_5Co_{3.6}Cr_8Mo_{0.4}B_{17}$ | 1108 | 487 |
| $Fe_{66}Ni_5Co_{3.4}Cr_8Mo_{0.6}B_{17}$ | 1101 | 494 |
| $Fe_{66}Ni_5Co_{3.2}Cr_8Mo_{0.8}B_{17}$ | 1105 | 498 |

EXAMPLE 3

Alloys Having High Strength and High Hardness Values

Other alloys having high hardness and high crystallization temperature values are given in Table III. These alloys are described by the general composition $M_{40-85}M'_{0-45}Cr_{0-20}Mo_{0-20}B_{15-25}$ Such alloys are useful in, for example, structural applications.

TABLE III

Thermal and Mechanical Properties of Some Iron Group-Boron Base Amorphous Alloys

| Alloy Composition (Atom Percent) | Hardness (DPH) | Crystallization Temperature (° C) |
|---|---|---|
| $Fe_{72}Ni_4Co_3Cr_5B_{16}$ | 1086 | 440,492 |
| $Fe_{66}Ni_5Co_4Cr_8B_{17}$ | 1088 | 486 |
| $Fe_{65}Ni_5Co_3Cr_{10}B_{17}$ | 1096 | 478 |
| $Fe_{65}Ni_2Co_2Cr_4Mo_{10}B_{17}$ | 1130 | 547 |
| $Fe_{65}V_{15}B_{20}$ | | 485 |
| $Fe_{63}Co_{10}Cr_7Mo_2B_{18}$ | 1130 | 512 |
| $Fe_{62}Ni_5Co_3Cr_7Mo_5B_{18}$ | 1115 | 530 |
| $Fe_{60}Ni_5Co_{10}Cr_5B_{20}$ | 1085 | 475 |
| $Fe_{60}Ni_5Co_3Cr_5Mo_{10}B_{17}$ | 1120 | 518 |
| $Fe_{60}Co_{10}Cr_{10}B_{20}$ | 1099 | 495 |
| $Fe_{58}Mn_{22}B_{20}$ | | 483 |
| $Fe_{55}Ni_5Co_3Cr_7Mo_{12}B_{18}$ | 1136 | 581 |
| $Fe_{50}Ni_{10}Co_{10}Cr_{10}B_{20}$ | 1020 | 483 |
| $Fe_{50}Co_{15}Cr_{15}Mo_4B_{16}$ | 1128 | 529,588 |
| $Fe_{45}Ni_{15}Co_{10}Cr_{10}B_{20}$ | 1017 | 484 |
| $Fe_{40}Ni_{20}Co_{10}Cr_{10}B_{20}$ | 990 | 481 |
| $Fe_{40}Ni_8Co_5Cr_{10}Mo_{20}B_{17}$ | 1187 | 607,677 |
| $Ni_{65}V_{15}B_{20}$ | | 505 |
| $Ni_{58}Mn_{20}B_{22}$ | | 517 |
| $Co_{45}Fe_{17}Ni_{13}Cr_5Mo_3B_{17}$ | 1108 | 540,628 |

EXAMPLE 4

Nickel Base Amorphous Metal Alloys

Table IV lists the composition, hardness and crystallization temperature of some nickel base amorphous alloys containing boron. These alloys were also found to possess high mechanical strength. The alloys are described by the composition $Ni_{40-50}Fe_{4-15}Co_{5-25}Cr_{8-12}Mo_{0-9}B_{15-23}$.

TABLE IV

Thermal and Mechanical Properties of Some Nickel Base Amorphous Alloys with Boron

| Alloy Composition (Atom percent) | Hardness (DPH) | Ultimate Tensile Strength (psi) | Crystallization Temperature (° C) |
|---|---|---|---|
| $Ni_{50}Fe_5Co_{17}Cr_9Mo_3B_{16}$ | 977 | | 432 |
| $Ni_{47}Fe_4Co_{23}Cr_9Mo_1B_{16}$ | 982 | | 400,473,575 |
| $Ni_{46}Fe_4Co_{23}Cr_9Mo_2B_{16}$ | 981 | | 420,500 |
| $Ni_{46}Fe_{10}Co_{20}Cr_8B_{16}$ | 980 | | 400,470,580 |
| $Ni_{46}Fe_{13}Co_{13}Cr_9Mo_3B_{16}$ | 995 | | 439,542 |
| $Ni_{45}Fe_5Co_{20}Cr_{10}Mo_4B_{16}$ | 1033 | 396,000 | 463,560 |
| $Ni_{44}Fe_{20}Co_5Cr_{10}Mo_4B_{17}$ | 1024 | | 422,608 |
| $Ni_{44}Fe_5Co_{24}Cr_{10}B_{17}$ | 1001 | | 425,463,615 |
| $Ni_{40}Fe_6Co_{20}Cr_{12}Mo_6B_{16}$ | 1033 | 396,000 | 478,641 |
| $Ni_{40}Fe_5Co_{20}Cr_{10}Mo_9B_{16}$ | 1043 | 413,000 | 466,570,673 |

EXAMPLE 5

Magnetic Alloys

The thermal properties of compositions found to be useful in magnetic applications are given in Table V. For some alloys, the room temperature saturation magnetization ($M_s$) in kGauss or the coercive force ($H_c$) in Oe of a strip under DC conditions is listed.

EXAMPLE 6

Corrosion-resistant Alloys

A number of iron group-boron base amorphous metal alloys were kept immersed in a solution of 10 wt% NaCl in water at room temperature for 450 hrs and subsequently visually inspected for their corrosion or oxidation characteristics. The results are given in Table VI. The amorphous alloys containing chromium showed excellent resistance to any corrosion or oxidation.

TABLE V

Thermal Properties of Some Magnetic Alloys

| Alloy Composition (Atom percent) | Saturation Magnetization ($M_s$) or Coercive Force ($H_c$) | Crystallization Temperature (° C) |
|---|---|---|
| $Fe_{40-80}Co_{5-45}B_{15-25}$: | | |
| $Fe_{80}Co_5B_{15}$ | $M_s$=15.6 kGauss | — |
| $Fe_{70}Co_{10}B_{20}$ | | 465 |
| $Fe_{50}Co_{30}B_{20}$ | | 493 |
| $Fe_{40}Co_{40}B_{20}$ | | 492 |
| $Co_{40-80}Fe_{5-45}B_{15-25}$: | | |
| $Co_{60}Fe_{20}B_{20}$ | | 483 |
| $Ni_{40-80}Fe_{5-45}B_{15-25}$: | | |
| $Ni_{70}Fe_{12}B_{18}$ | | 435 |
| $Ni_{60}Fe_{22}B_{18}$ | $H_c$=0.059 Oe | 444 |
| $Ni_{50}Fe_{32}B_{18}$ | $H_c$=0.029 Oe | 456 |
| $Fe_{40-70}Ni_{4-25}Co_{5-30}B_{15-25}$: | | |
| $Fe_{70}Ni_4Co_5B_{21}$ | | 455 |
| $Fe_{70}Ni_{7.5}Co_{7.5}B_{15}$ | $M_s$=13.7 kGauss | 435,504 |
| $Fe_{65}Ni_7Co_7B_{21}$ | $M_s$=13.45 kGauss | 465 |
| $Fe_{60}Ni_7Co_{12}B_{21}$ | | 472 |
| $Fe_{50}Ni_{20}Co_{15}B_{15}$ | $H_c$=0.038 Oe | 422,458 |
| $Fe_{50}Ni_5Co_{28}B_{17}$ | | 450,492 |
| $Fe_{40}Ni_{15}Co_{25}B_{20}$ | | 473 |
| $Ni_{40-70}Fe_{5-25}Co_{5-25}B_{15-25}$: | | |
| $Ni_{60}Fe_{13}Co_{10}B_{17}$ | | 373 |
| $Ni_{50}Fe_{18}Co_{15}B_{17}$ | | 405 |
| $Ni_{40}Fe_{20}Co_{23}B_{17}$ | | 423 |
| $Co_{40-70}Fe_{5-25}Ni_{5-25}B_{15-25}$: | | |
| $Co_{68}Fe_{7.5}Ni_{7.5}B_{17}$ | | 432 |
| $Co_{60}Fe_{13}Ni_{10}B_{17}$ | | 442 |
| $Co_{50}Fe_{18}Ni_{15}B_{17}$ | | 437,450 |
| $Co_{40}Fe_{20}Ni_{17}B_{23}$ | | 462 |
| Other: | | |
| $Fe_{81}Co_3Ni_1B_{15}$ | $M_s$=15.1 kGauss | — |

TABLE VI

Results of Corrosion Test of Some Iron, Nickel and Cobalt Base Amorphous Alloys with Boron

| | |
|---|---|
| $Fe_{66}Ni_5Co_{3.6}Cr_8Mo_{0.4}B_{17}$ | No corrosion, oxidation |

TABLE VI-continued

Results of Corrosion Test of Some Iron, Nickel and Cobalt Base Amorphous Alloys with Boron

| | |
|---|---|
| | or discoloration |
| $Fe_{65}Ni_5Co_3Cr_{10}B_{17}$ | " |
| $Fe_{63}Ni_5Co_3Cr_7Mo_4B_{18}$ | " |
| $Fe_{55}Ni_8Co_5Cr_{15}B_{17}$ | " |
| $Fe_{54}Ni_6Co_5Cr_{15}Mo_2B_{18}$ | " |
| $Fe_{50}Ni_{10}Co_{10}Cr_{10}B_{20}$ | " |
| $Fe_{40}Ni_{15}Co_{25}B_{20}$ | Corroded & tarnished |
| $Ni_{44}Fe_{20}Co_5Cr_{10}Mo_4B_{17}$ | No corrosion, oxidation or discoloration |
| $Ni_{40}Fe_5Co_{20}Cr_{10}Mo_9B_{16}$ | " |
| $Co_{50}Fe_{18}Ni_{15}B_{17}$ | Corroded & tarnished |

EXAMPLE 7

Thermal Aging of Alloys

A number of iron group-boron base amorphous metal alloys were thermally aged in the temperature range 250° to 375° C in air for ½ to 1 hr and evaluated for embrittlement. The heat treated strips were bent to form a loop. The diameter of the loop was gradually reduced between the anvils of a micrometer until fracture occurred. The average breaking diameter of the amorphous alloy strip obtained from micrometer readings is indicative of its ductility. A low number indicates good ductility. For example, the number zero means that the amorphous ribbon is fully ductile. The results are tabulated in Tables VII and VIII.

| Alloy Composition (Atom Percent) | Thickness (mils) | Average Breaking Diameter (mis) 250° C 1 hr | 275° C 1 hr | 300° C 1 hr | 325° C 1 hr | 345° C ½ hr | 360° C ½ hr | 375° C ½ hr | Crystallization Temperature (° C) |
|---|---|---|---|---|---|---|---|---|---|
| $Fe_{66}Ni_5Co_{3.2}Cr_8Mo_{0.8}B_{17}$ | 2 | 0 | 0 | 0 | 0 | 0 | 0 | 0 | 498 |
| $Fe_{66}Ni_5Co_{3.6}Cr_8Mo_{0.4}B_{17}$ | 1.35 | 0 | 0 | 0 | 0 | 0 | 0 | 0 | 487 |
| $Fe_{66}Ni_5Co_{3.8}Cr_8Mo_{0.2}B_{17}$ | 1.4 | 0 | 0 | 0 | 0 | 0 | 0 | 10 | 488 |
| $Fe_{66}Ni_5Co_4Cr_8B_{17}$ | 1.2 | 0 | 0 | 0 | 0 | 0 | 0 | 30 | 486 |
| $Fe_{67}Ni_5Co_3Cr_7B_{18}$ | 1.8 | 0 | 0 | 0 | 0 | 0 | 0 | 30 | 488 |
| $Fe_{65}Ni_5Co_3Cr_{10}B_{17}$ | 1.7 | 0 | 0 | 0 | 0 | 0 | 0 | 37 | 478 |
| $Fe_{60}Ni_7Co_7Cr_8B_{18}$ | 1.5 | 0 | 0 | 0 | 0 | 0 | 25 | | 481 |
| $Fe_{63}Ni_5Co_3Cr_7Mo_4B_{18}$ | 2.3 | 0 | 0 | 0 | 40 | 50 | | | 528 |
| $Fe_{45}Ni_{15}Co_{10}Cr_{10}B_{20}$ | 1.45 | 0 | 0 | 0 | 35 | | | | 484 |
| $Fe_{55}Ni_{10}Co_5Cr_{10}B_{20}$ | 1.8 | 0 | 0 | 0 | 50 | | | | 487 |
| $Fe_{55}Ni_8Co_5Cr_{15}B_{17}$ | 1.75 | 0 | 0 | 16 | 35 | 45 | | | 496 |
| $Fe_{65}Ni_2Co_2Cr_4Mo_{10}B_{17}$ | 1.6 | 0 | 0 | 25 | | | | | 547 |
| $Fe_{65}Ni_7Co_7B_{21}$ | 1.5 | 0 | 0 | 25 | | | | | 465 |
| $Fe_{70}Ni_4Co_5B_{21}$ | 1.6 | 0 | 0 | 30 | | | | | 455 |
| $Fe_{54}Ni_6Co_5Cr_{16}Mo_2B_{17}$ | 2 | 0 | 0 | 30 | | | | | 519 |
| $Fe_{53}Ni_6Co_5Cr_{16}Mo_3B_{17}$ | 1.7 | 0 | 35 | | | | | | 508 |

TABLE VIII

Results of Embrittlement Studies on Nickel-Base Boron Amorphous Metal Alloys

| Alloy Composition (Atom percent) | Thickness (mils) | Average Breaking Diameter (mils) 325° C ½ hr | 340° C ½ hr | 355° C ½ hr | 360° C ½ hr | 375° C ½ hr |
|---|---|---|---|---|---|---|
| $Ni_{45}Fe_5Co_{20}Cr_{10}Mo_4B_{16}$ | 1.5 | 0 | 0 | 0 | 0 | 0 |
| $Ni_{44}Fe_5Co_{24}Cr_{10}B_{17}$ | 1.35 | 0 | 0 | 0 | 0 | 15 |
| $Ni_{50}Fe_5Co_{17}Cr_9Mo_3B_{16}$ | 1.2 | 0 | 0 | 0 | 20 | |
| $Ni_{46}Fe_4Co_{23}Cr_9Mo_2B_{16}$ | 1.4 | 0 | 0 | 0 | 25 | |
| $Ni_{46}Fe_{10}Co_{20}Cr_8B_{16}$ | 1.2 | 0 | 0 | 15 | | |
| $Ni_{46}Fe_{13}Co_{13}Cr_9Mo_3B_{16}$ | 1.4 | 0 | 10 | | | |
| $Ni_{40}Fe_6Co_{20}Cr_{12}Mo_6B_{16}$ | 1.4 | 0 | 15 | | | |
| $Ni_{40}Fe_5Co_{20}Cr_{10}Mo_9B_{16}$ | 1.4 | 0 | 25 | | | |

What is claimed is:

1. An amorphous metal alloy that is at least 50% amorphous, has improved ultimate tensile strength and hardness and does not embrittle when heat treated, characterized in that the alloy consists essentially of the composition $M_aM'_bCr_cM''_dB_e$, where M is one element selected from the group consisting of iron, cobalt and nickel, M' is one or two elements selected from the group consisting of iron, cobalt and nickel other than M, M″ is at least one element selected from the group consisting of vanadium, manganese, molybdenum, tungsten, niobium and tantalum, "*a*" ranges from about 40 to 85 atom percent, "*b*" ranges from 0 to about 45 atom percent, "*c*" and "*d*" each range from 0 to about 20 atom percent and "*e*" ranges from about 15 to 25 atom percent, with the proviso that "*b*", "*c*" and "*d*" cannot all be zero simultaneously.

2. The amorphous metal alloy of claim 1 in which "*e*" ranges from about 17 to 22 atom percent.

3. The amorphous metal alloy of claim 1 in which "*c*" ranges from about 4 to 16 atom percent.

4. The amorphous metal alloy of claim 1 in which M″ is molybdenum and "*d*" ranges from about 0.4 to 8 atom percent.

5. The amorphous metal alloy of claim 4 in which "*d*" ranges from about 0.4 to 0.8 atom percent.

6. The amorphous metal alloy of claim 4 in which "*d*" ranges from about 4 to 8 atom percent.

7. The amorphous metal alloy of claim 1 consisting essentially of the composition $$Fe_{50-70}(Ni,Co)_{5-15}Cr_{5-16}Mo_{0-8}B_{16-22}.$$

8. The amorphous metal alloy of claim 1 consisting essentially of the composition $$Fe_{60-67}Ni_{3-7}Co_{3-7}Cr_{7-10}Mo_{0.4-0.8}B_{17-20}.$$

9. The amorphous metal alloy of claim 1 consisting essentially of the composition $$Ni_{40-50}Fe_{4-10}Co_{5-25}Cr_{8-12}Mo_{0-9}B_{15-22}.$$

10. The amorphous metal alloy of claim 1 consisting essentially of the composition $$Co_{40-50}Fe_{5-20}Ni_{0-20}Cr_{4-15}Mo_{0-9}B_{15-23}.$$

11. The amorphous metal alloy of claim 1 in which "*c*" and "*d*" are both zero.

12. The amorphous metal alloy of claim 9 consisting essentially of the composition $Ni_{45}Fe_5Co_{20}Cr_{10}Mo_4B_{16}$.

13. The amorphous metal alloy of claim 10 consisting essentially of the composition $Fe_{70}Co_{10}B_{20}$.

* * * * *

UNITED STATES PATENT AND TRADEMARK OFFICE

CERTIFICATE OF CORRECTION

PATENT NO. : 4,067,732

DATED : January 10, 1978

INVENTOR(S) : Ranjan Ray

It is certified that error appears in the above-identified patent and that said Letters Patent are hereby corrected as shown below:

Column 2, line 15: insert -- a -- before "melt".

Column 3, line 66: insert -- atom -- after "8".

Column 4, line 24: "he" should read -- the --.

Column 4, line 38: "550" should read -- 555 --.

Column 4, line 59: delete "in".

Column 4, line 59: "$Br_{16}$" should read -- $B_{16}$ --.

Column 4, line 59-60: delete "$Ni_{45}Fe_5Co_{20}Cr_{10}Mo_9B_{16}$".

Column 5, line 18: "$B_{15}$" should read -- $B_{15-25}$ --.

Column 5, line 38: "$co_{50}$" should read -- $Co_{50}$ --.

Column 5, line 40: "$10^{50}$" should read -- $10^5$ --.

Column 9, line 30: insert "TABLE VII".

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*